US006652114B2

(12) United States Patent
Ancel

(10) Patent No.: US 6,652,114 B2
(45) Date of Patent: Nov. 25, 2003

(54) BRACKET FOR LOADING DOCK TRAFFIC SIGNAL DOCK LIGHT

(76) Inventor: Thomas A. Ancel, Beacon Industries, 7321 S. Lindberg Blvd., St. Louis, MO (US) 63125

( * ) Notice: Subject to any disclaimer, the term of this patent is extended or adjusted under 35 U.S.C. 154(b) by 0 days.

(21) Appl. No.: 10/072,861

(22) Filed: Feb. 9, 2002

(65) Prior Publication Data

US 2003/0151913 A1 Aug. 14, 2003

(51) Int. Cl.[7] ..... F21S 8/00

(52) U.S. Cl. ..... 362/147; 362/145; 362/370; 362/432

(58) Field of Search ..... 362/147, 234, 362/432, 396, 145, 370; 340/932.2

(56) References Cited

U.S. PATENT DOCUMENTS 2,846,570 A * 8/1958 Harling ..... 362/396

* cited by examiner

*Primary Examiner*—Sandra O'Shea
*Assistant Examiner*—Guiyoung Lee
(74) *Attorney, Agent, or Firm*—Henry W. Cummings

(57) ABSTRACT

The present invention is a bracket assembly for supporting a traffic signal dock light, comprising of a three-dimensional offset face mounting bracket to be mounted to the building exterior loading dock door jamb. The load of the traffic signal light is transferred to the exterior door jamb of the building. The bracket assembly of the present invention has adequate distance between the door jamb and traffic signal dock light to provide proper installation for the dock door seal.

4 Claims, 4 Drawing Sheets

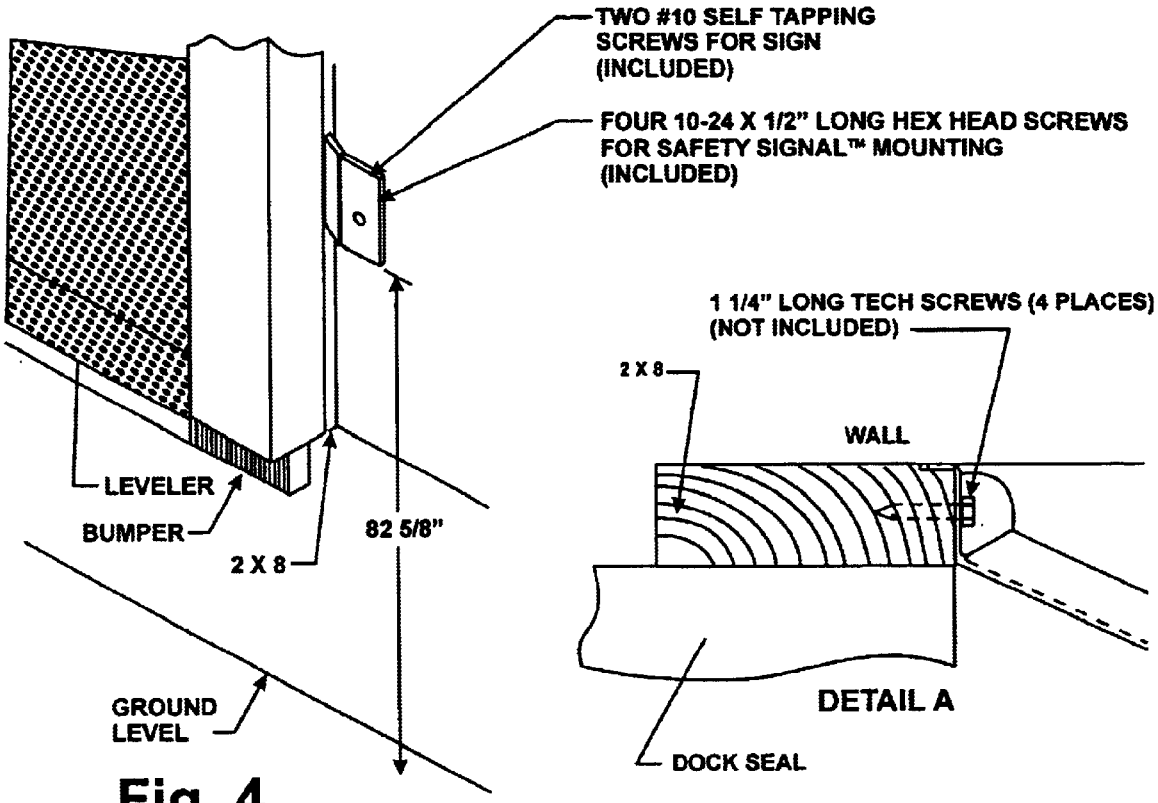
Fig. 4 (Prior Art)
Fig. 5A (Prior Art)
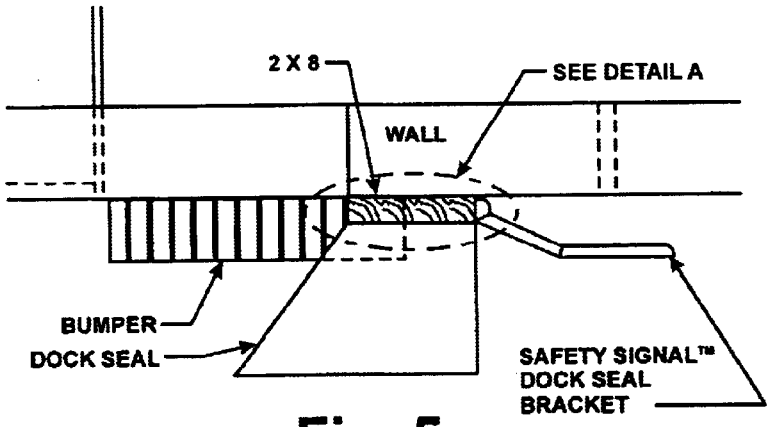
Fig. 5 (Prior Art)

BRACKET FOR LOADING DOCK TRAFFIC SIGNAL DOCK LIGHT

1. FIELD OF THE INVENTION

This invention relates to a bracket for the loading dock outside traffic signal dock light.

2. BACKGROUND OF THE INVENTION

Loading dock traffic signal dock light brackets are necessary to mount properly an outside loading dock traffic signal dock light. Traffic Light brackets have been developed to support a traffic light.

U.S. Pat. No. 5,105,350 discloses a bracket arm mechanism for mounting multiple traffic light assemblies on a common vertical post structure. At least one bracket arm has a collar at one end for telescopement onto the post structure so that the arm is adjustable vertically to accomodate a traffic light assembly of reduced vertical height. An angular transition portion between each collar and the main portion of the associated bracket arm provides for the bracket arms being in a common plane suitable for mounting a plural number of standard height traffic light assemblies on the post structure.

3. SUMMARY OF THE INVENTION

A. OBJECTS OF THE INVENTION

One object of the present invention is to provide a means to support and mount an outside loading dock traffic signal dock light. The primary means of the bracket of the present invention is to transfer the weight and dynamic load of the outside traffic signal dock light to the building loading dock door jamb structure.

Another object of the present invention is to keep the load of the traffic signal dock light and the traffic signal dock light bracket off the building wall skin structure.

Another object of the present invention is to keep the load of the traffic signal dock light and the traffic signal dock light bracket off the door seal structure.

Other objects of the present invention will become apparent from the following description and drawings.

B. SUMMARY

The present invention comprises of a bracket for outside loading dock traffic signal dock lights. The bracket mounts to the exterior door jamb of a building near the loading dock door opening. The design device allows for the mounting of the signal dock light on a building with various building skin wall textures or operational wall louvers.

The present invention is a devise, which supports the outside traffic signal dock light at a loading dock for loading and unloading procedures. As professionals working with such construction understand, brackets screwing to a door seal or on the skin of the building is simply not proper construction, primarily if the building is constructed with louvered exterior skin walls. The bracket for the exterior traffic signal dock light of the present invention with its three dimension body frame provides a proper distance clearance design away the building skin wall without touching the wall or relying on the exterior building wall for support. The bracket for the traffic signal dock light is designed to take on and be supported by the building loading dock door jamb structure. The present invention is a simple mechanical devise, which reduces structural fatigue on the door seal or the skin of the building, lowers maintenance and repair.

The traffic signal dock light bracket transfers the physical weight and dynamic wind load from the traffic signal dock light to the building loading dock door jamb. The device design allows for the mounting of the outside traffic signal dock light at a specific distance from the loading dock door opening and dock door seal without conforming to building column spacing designs to carry the load of the traffic signal dock light. A predetermined measurement distance and consistency for the entire building traffic signal dock light layout can be accomplished with the present design for the traffic signal dock light spacing between the door opening and the traffic signal dock light.

The device design allows for the mounting of the signal dock light on the building face when corrugated building skins are present in the building design. The device design allows for the mounting of the traffic signal dock light on a building face when louvered walls are present in the building skin design. The device design allows for the mounting of the signal dock light on a building face when concrete or concrete block walls are present in the building face skin design.

The traffic signal dock light bracket of the present invention allows for the mounting of a traffic signal dock light without drilling mounting holes in the face of building walls or face of building skins, keeping the face walls of the building strong, intact and or insulated. The device of the present invention includes mounting holes for the door jamb mounting application keeping a solid mounting procedure to the building. The bracket of the present invention at the door jamb mounting location is covered up and protected after installation with the dock door seal structure.

The traffic signal dock light bracket of the present invention allows for the mounting of a traffic signal dock light bracket on the building door jamb at the dock door opening, keeping the mounting fastening and anchoring procedure off dock door seal structure. The present invention is designed without the requirement of the dock door seal to carry the load from the traffic signal dock light bracket. The present invention is designed without the requirement of drilling mounting holes in the dock door seal frame, therefore keeping the dock door seal frame mounted on the building strong and intact without destroying the dock door seal or material or affecting the dock door seal warranty.

The traffic signal dock light bracket is designed with an off set three-dimensional curve. The curve allows for the clearance between the traffic signal dock light bracket and the building skin, walls and building louvers. The curve of the present invention has a set angle to create a distance between the traffic signal dock light bracket plane that mounts to the dock door jamb and the building skin face exterior walls. The curve angle creates an offset in the present invention face plane, thus allowing for building skin wall louvers to open and close without the interference of the traffic signal dock light bracket.

4. THE DRAWINGS

FIG. 4 is a perspective view of a prior art dock seal bracket.

FIG. 5 is a plan view of the dock seal bracket in FIG. 4.

FIG. 5A is a detail view of FIG. 5.

5. DESCRIPTION OF THE PREFERRED EMBODIMENTS

Figure 1:
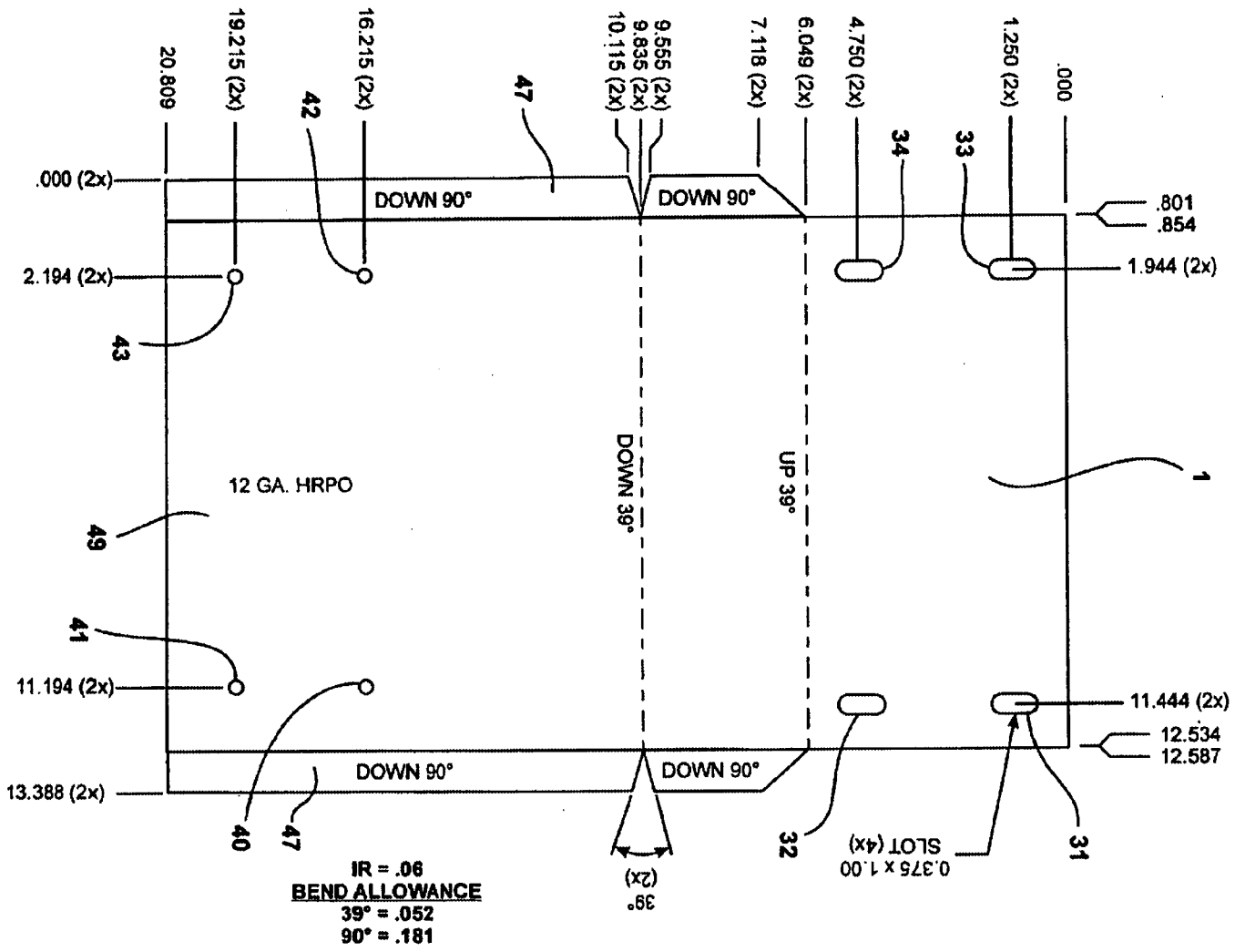
FIG. 1 is a frontal view of the bracket of the present invention.
Figure 2:
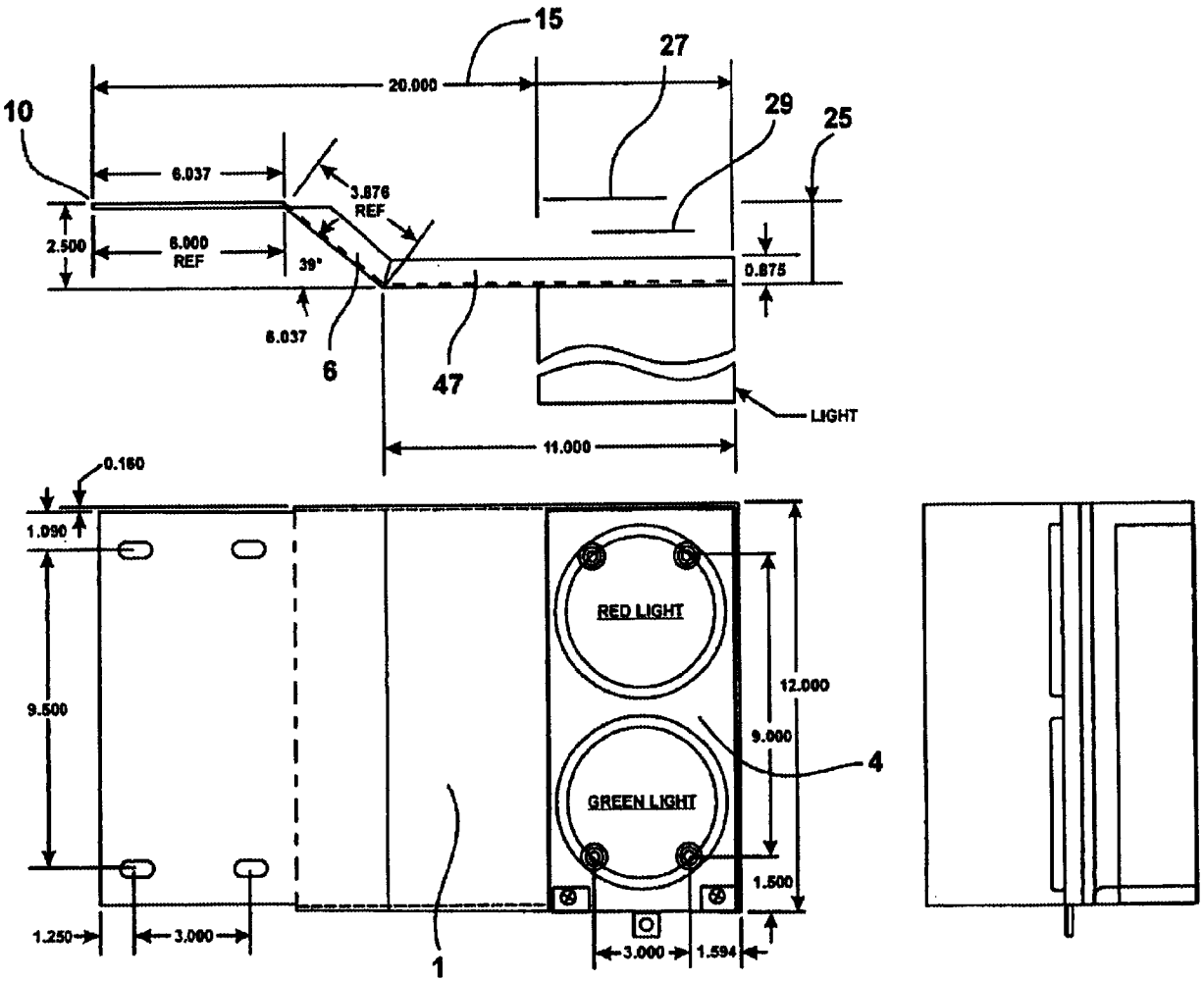
FIG. 2 is a frontal view and top view of the present invention with a traffic signal dock light mounted to the present invention.
Figure 3:
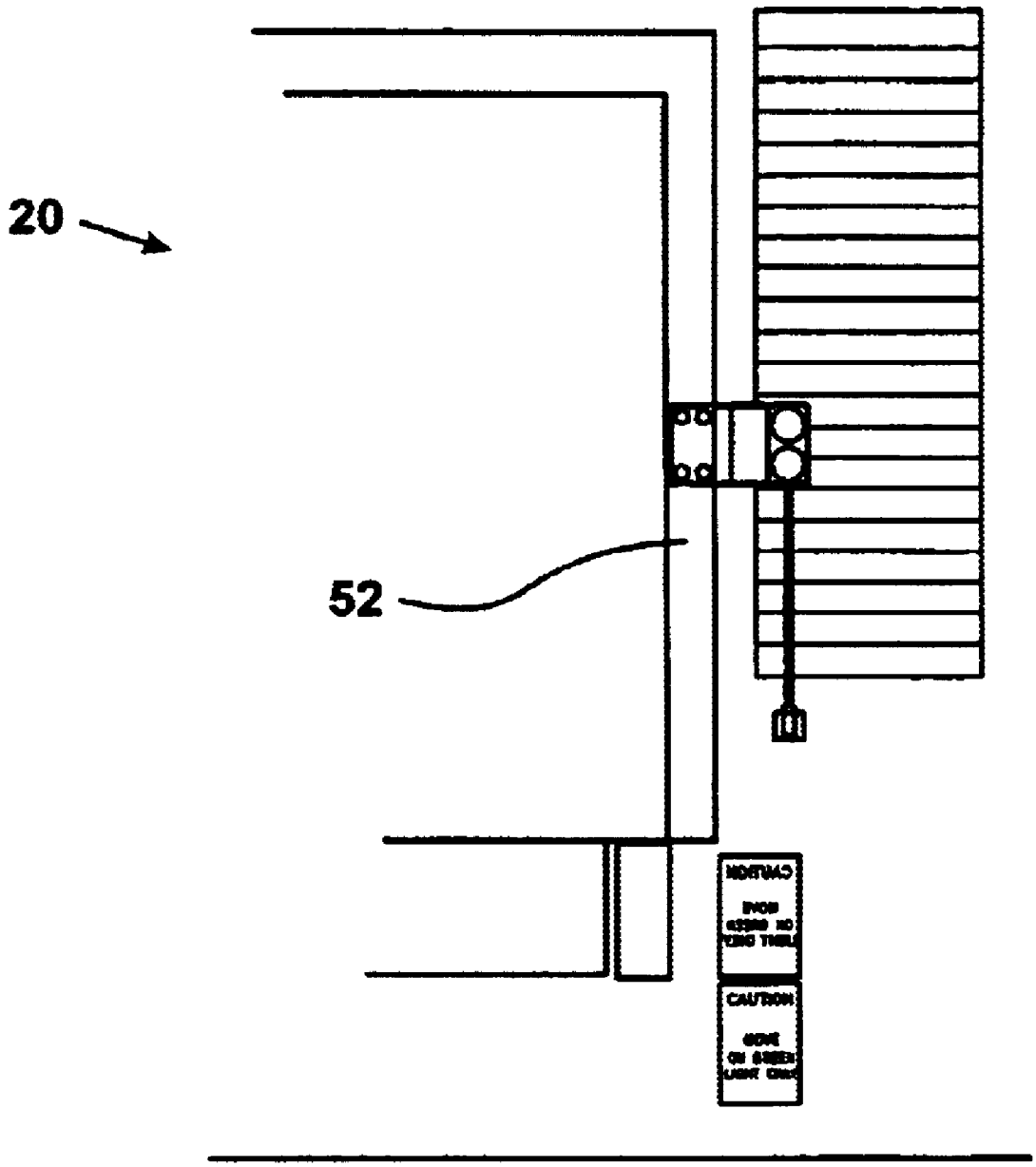
FIG. 3 is a frontal view of the bracket of the present invention mounted to the building door jamb structure with the traffic signal dock light installed on the present invention.

FIGS. 1 through 3 illustrate the bracket for a loading dock traffic signal dock light of the present invention.

The standard application for installing traffic signal dock lights are directly to the building skin walls or a mounting bracket anchored to the loading dock door seal.

An advantage of the of the present invention is to provide the ability to keep the traffic signal dock light bracket and traffic signal dock light anchoring load off the building exterior skin walls. Another advantage of the present invention is preventing the drilling of holes for anchoring in the building skin and only requiring for the drilling of holes in the loading dock doorjamb.

Another advantage of the present invention is consistent spacing from the dock door opening to the traffic signal dock light.

Another advantage of the present invention is all the load is applied to the building door jamb and not to the dock door seal structure.

Another advantage of the present invention is to provide the ability for mounting a traffic signal dock light when louvered wall skins are present.

The bracket 1 for the traffic signal dock light 4 includes an angle 6 to off set the traffic signal dock light 4 from the doorjamb face plane 10. The distance 15 of the traffic signal dock light 4 has a predetermined measurement to the dock door opening 20.

The bracket 1 for the traffic signal dock light 4 has a predetermined distance 25 from the building wall skin 27 or open louver measurement 29.

The bracket 1 for the traffic signal dock light 4 has door jamb 52 mounting anchor holes 31, 32, 33, 34 for mechanical fasteners or welding.

The bracket 1 for the traffic signal dock light 4 has traffic signal dock light mounting anchor holes 40, 41, 42, 43 for mechanical fasteners.

The bracket 1 for the traffic signal dock light 4 has a flat plate 49 and gussets on the offset angle 47 for support.

What is claimed is:

1. A bracket for mounting and supporting loading dock traffic signal dock lights on a building wall having a door jam comprising:

a bracket having mounting said bracket to said door jamb;

a body portion extending outwardly from said mounting means; an extension extending outwardly from said body portion having means for mounting said loading dock traffic signal lights thereon;

whereby said extension and said-body portion transfer the traffic dock light load to said door jamb.

2. A bracket for supporting loading dock traffic signal dock lights according to claim 1 wherein said building includes skin structure extending outwardky therefrom and body portion is contoured in a three-dimensional offset to clear said skin structure.

3. A bracket for supporting loading dock traffic signal dock lights according to claim 2 wherein said building includes open and closed louvers and said body portion includes a three-dimensional offset which extends a predetermined distance sufficient to clear said open and m, closed louvers id said skin structure.

4. A bracket for supporting loading dock traffic signal dock lights according to claim 1 wherein said bracket is located a predetermined distance from said door jamb.

* * * * *